US009570818B2

(12) United States Patent
Som et al.

(10) Patent No.: US 9,570,818 B2
(45) Date of Patent: Feb. 14, 2017

(54) CONTACTING DEVICE FOR CONNECTING AN ELECTRICAL CONDUCTOR

(71) Applicant: EPCOS AG, Munich (DE)

(72) Inventors: Cem Som, Zorneding (DE); Gino Yang, Zhuhai (CN); Park Cai, Zhuhai (CN)

(73) Assignee: EPCOS AG, Munich (DE)

( * ) Notice: Subject to any disclaimer, the term of this patent is extended or adjusted under 35 U.S.C. 154(b) by 88 days.

(21) Appl. No.: 14/391,693

(22) PCT Filed: Apr. 12, 2013

(86) PCT No.: PCT/EP2013/057703

§ 371 (c)(1),
(2) Date: Oct. 9, 2014

(87) PCT Pub. No.: WO2013/153206

PCT Pub. Date: Oct. 17, 2013

(65) Prior Publication Data

US 2015/0145633 A1 May 28, 2015

(30) Foreign Application Priority Data

Apr. 12, 2012 (DE) ..... 10 2012 103 162

(51) Int. Cl.
*H01F 27/29* (2006.01)
*H01F 27/30* (2006.01)
(Continued)

(52) U.S. Cl.
CPC ..... *H01R 4/625* (2013.01); *H01F 27/28* (2013.01); *H01R 4/10* (2013.01); *H01R 4/2416* (2013.01);
(Continued)

(58) Field of Classification Search
CPC ..... H01F 27/292; H01F 38/12; H01F 27/325; H01F 30/16
(Continued)

(56) References Cited

U.S. PATENT DOCUMENTS

| | | | | |
|---|---|---|---|---|
| 5,726,619 | A | 3/1998 | Hohorst et al. | |
| 5,759,061 | A | 6/1998 | Jensen et al. | |
| 6,142,817 | A | 11/2000 | Lee | |
| 6,866,536 | B1 | 3/2005 | Lee | |
| 2008/0020626 | A1 * | 1/2008 | Scherer | H01R 4/2433 439/402 |

(Continued)

FOREIGN PATENT DOCUMENTS

| | | | |
|---|---|---|---|
| CN | 101501935 | A | 8/2009 |
| DE | 2125951 | A1 | 12/1972 |

(Continued)

*Primary Examiner* — Tsz Chan
(74) *Attorney, Agent, or Firm* — McDermott Will & Emery LLP

(57) ABSTRACT

A contacting device (100) for connecting an electrical conductor (11) comprises a connection contact (101) for fixing the electrical conductor (11) to the contacting device (100), wherein the connection contact (101) has a retainer (110). The retainer (110) has an accommodating region (112) for accommodating the electrical conductor (11). The accommodating region (112) tapers between an inlet opening (E112) and a base surface (B112) of the accommodating region (112) in such a way that a cross section (A11) of the electrical conductor (11) is deformed when the electrical conductor (11) is inserted into the accommodating region (112), whereby the electrical conductor is retained on the connection contact (101) in the clamping seat. The electrical conductor (11) can thus be fixed to the connection contact (101) without bending of the retainer (110).

14 Claims, 5 Drawing Sheets

Figure 1A:
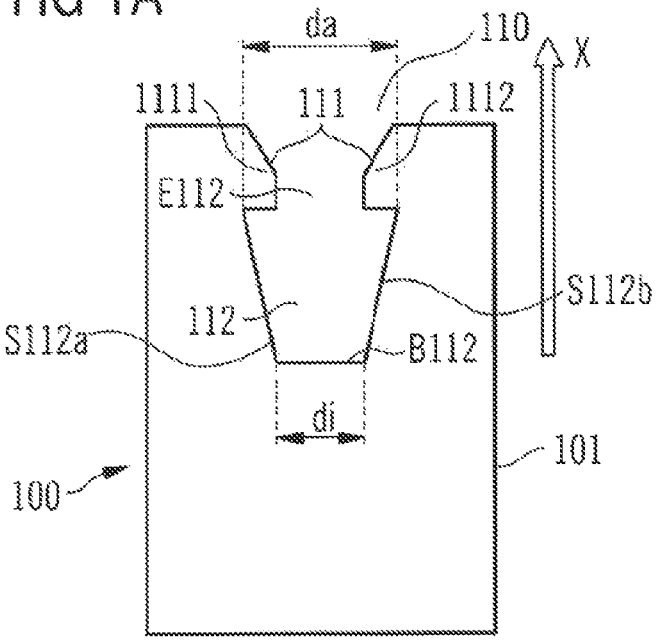

(51) Int. Cl.

| | |
|---|---|
| ***H01R 4/24*** | (2006.01) |
| ***H01R 11/20*** | (2006.01) |
| ***H01R 4/10*** | (2006.01) |
| ***H01R 9/24*** | (2006.01) |
| ***H01R 4/62*** | (2006.01) |
| ***H01F 27/28*** | (2006.01) |
| ***H01R 43/02*** | (2006.01) |
| ***H01R 43/04*** | (2006.01) |

(52) U.S. Cl.
CPC ..... *H01R 43/0235* (2013.01); *H01R 43/04* (2013.01); *Y10T 29/49179* (2015.01); *Y10T 29/49183* (2015.01)

(58) Field of Classification Search
USPC .... 336/83, 90, 198, 229, 192; 439/395, 397, 439/398, 400, 402–406, 409, 439/620.21–620.23, 638, 709, 741, 871, 439/877, 878, 884, 888
See application file for complete search history.

(56) References Cited

U.S. PATENT DOCUMENTS

| | | | | |
|---|---|---|---|---|
| 2010/0035484 | A1 | 2/2010 | Horn | |
| 2011/0117769 | A1* | 5/2011 | Okamura ..... | H01R 4/185 439/395 |

FOREIGN PATENT DOCUMENTS

| | | | |
|---|---|---|---|
| DE | 2520799 | A1 | 11/1976 |
| DE | 2814009 | A1 | 10/1979 |
| DE | 8528530 | U1 | 11/1985 |
| DE | 19508695 | A1 | 9/1996 |
| EP | 1811602 | A1 | 7/2007 |
| GB | 2141593 | A | 12/1984 |
| JP | S5584875 | U | 6/1980 |
| JP | S6418822 | U | 1/1989 |
| JP | H01146466 | U | 10/1989 |
| JP | H0511328 | U | 2/1993 |
| WO | WO-2008011449 | A2 | 1/2008 |

* cited by examiner

CONTACTING DEVICE FOR CONNECTING AN ELECTRICAL CONDUCTOR

The invention relates to a contacting device for connecting an electrical conductor, a coil former and an inductive electrical component. The invention also relates to a method for connecting an electrical conductor to a contacting device of a coil former.

In electronic circuits and in the case of electronic components, it is often necessary to connect electrical conductors to a contacting device. Electronic components of this type include inductive components, for example coil formers, around which an electrical conductor is wound. For contacting, the coil former may have a contacting device comprising contact elements. For example, the contact elements may be contact pins, by means of which an inductive component, which contains the coil former, can be connected to further components of an electronic circuit.

An electrical conductor that is wound on the coil former has to be connected to the contacting device comprising the contact pin. For example, an electrical conductor of this type may be a stranded wire or an enameled wire. In particular, the connection of the electrical conductor may be difficult when the electrical conductor has a larger cross section than the outer contact elements/contact pins of the coil former.

It is desirable to specify a contacting device for connecting an electrical conductor, with which it is made possible to connect the electrical conductor to the contacting device reliably and in an easily handled manner. There is also a need to specify a coil former around which an electrical conductor is to be wound, with which an electrical conductor can be reliably connected to a contacting device of the coil former in an easily handled manner. Furthermore, an inductive electrical component, in particular a coil or a transformer, is to be specified, with which an electrical conductor can be reliably connected to a contacting device in an easily handled manner. A method for connecting an electrical conductor to a contacting device of a coil former is additionally to be specified.

One embodiment of a contacting device for connecting an electrical conductor is specified in claim 1.

In accordance with a possible embodiment, a contacting device for connecting an electrical conductor comprises a connection contact for fixing the electrical conductor to the contacting device, wherein the connection contact has a retainer. The retainer has an accommodating region for accommodating the electrical conductor. The retainer is formed in such a way that the electrical conductor can be connected to the connection contact by being clamped in the retainer and without bending of the retainer. The accommodating region has an inlet opening and a base surface and extends between the inlet opening and the base surface. The accommodating region tapers between the inlet opening and the base surface in such a way that a cross section of the electrical conductor is deformed when the electrical conductor is inserted into the accommodating region, whereby the electrical conductor is retained on the connection contact in a clamping seat.

By being pressed into the accommodating region manually or in an automated manner, the electrical conductor can be connected to the connection contact in the clamping seat on account of the deformation and the stress occurring during this process.

The accommodating region may be trapezoidal or V-shaped in cross section. The accommodating region may have at least one first side wall and at least one second side wall, wherein the at least one first and the at least one second side wall extend from opposite sides of the base surface to the inlet opening. The first and second side wall can be arranged between the inlet opening and the base surface in such a way that the accommodating region tapers continuously from the inlet opening to the base surface. The retainer is thus formed in such a way that the electrical conductor can be fixed to the retainer without bending of the at least one first and the at least one second side wall.

In accordance with a further embodiment, a corner may be formed between the at least one first side wall and the base surface and between the at least one second side wall and the base surface. The at least one first side wall and the at least one second side wall can each be arranged at an angle of inclination between 5° to 15° with respect to a perpendicular to the base surface. The angle of inclination is preferably 5° to 7°.

In accordance with a further embodiment of the contacting device, the distance between the at least one first side wall and the at least one second side wall immediately beneath the inlet opening may be greater than the width of the base surface between the at least one first side wall and the at least one second side wall. In particular, the ratio between the distance between the at least one first side wall and the at least one second side wall immediately beneath the inlet opening and the width of the base surface between the at least one first and the at least one second side wall may be 1.2 to 3.

In accordance with a further embodiment of the contacting device, the retainer has at least one protrusion, which narrows the inlet opening into the accommodating region. When the electrical conductor is inserted through the inlet opening, initially still loosely, into the accommodating region of the retainer, the protrusion prevents the conductor from slipping out from the accommodating region. The protrusion can be configured in the form of hooks. For example, the protrusion can be formed by two hooks, wherein the distance between the two hooks or protrusions is preferably adapted to the cross section of the electrical conductor. The protrusions may thus for example cause a clamping or fixing in an x-direction, that is to say in the direction of the normal to the base surface.

The accommodating region can be formed as a material recess in the form of a groove in the material of the connection contact. The material recess can be shaped in such a way that, when the conductor is pressed into the accommodating region under force or when said electrical conductor is pushed under force against the base surface and the side walls of the accommodating region, the cross section of the electrical conductor is deformed in the material recess and is thus held in a clamping seat in the accommodating region. The inner surface of the recess must be adapted for this purpose to a cross section of the electrical conductor. By way of example, the recess can be formed in such a way that a previously approximately round cross section of the electrical conductor is deformed as the conductor is pressed into the accommodating region and the electrical conductor can thus also be fixed in a z-direction perpendicular to the x-direction.

The contacting device further comprises a contact peg for applying an electrical signal. The connection contact and the contact peg are interconnected and are formed from the same material piece.

Claim 10 defines a coil former around which an electrical conductor is to be wound. The coil former comprises a contacting device for connecting the electrical conductor according to the above-mentioned embodiment. For example, the contacting device can be embedded in the material of the coil former. The contacting device can be overmoulded by the material of the coil former or can be cast into the material of the coil former.

Claim 11 specifies an inductive electrical component, in particular a coil or a transformer. The component comprises the coil former of the previously mentioned type, wherein the electrical conductor is wound around the coil former. The electrical conductor is held in the accommodating region of the connection contact in a clamping seat. The electrical conductor can be formed here as a stranded or enameled wire with a cross section between 0.05 $mm^2$ and 95 $mm^2$, for example with a cross section of 1.6 $mm^2$.

An embodiment of a method for connecting an electrical conductor to a contacting device of a coil former is specified in claim 13. The method accordingly comprises the following steps:

providing the previously specified coil former, fixing the electrical conductor to the connection contact of the contacting device by inserting the electrical conductor into the accommodating region of the connection contact in such a way that the cross section of the electrical conductor is deformed when the electrical conductor is inserted into the accommodating region, whereby the electrical conductor is retained on the connection contact in a clamping seat.

Here, the electrical conductor, following the insertion through the inlet opening into the accommodating region, is firstly fixed by the protrusion in a first direction parallel to the perpendicular to the base surface of the accommodating region, such that the electrical conductor can no longer slide out from the accommodating region. The electrical conductor is then fixed to the connection contact in a second direction perpendicular to the first direction by being pressed against the base surface. The electrical conductor can be fixed to the connection contact in such a way that an end of the electrical conductor protrudes from the retainer. To electrically contact the conductor to the connection contact, a solder material is applied to the end of the electrical conductor. An insulating sheathing around the conducting wires of the electrical conductor thus melts, whereby the end of the electrical conductor is electrically contacted with the connection contact.

Figure 1B:
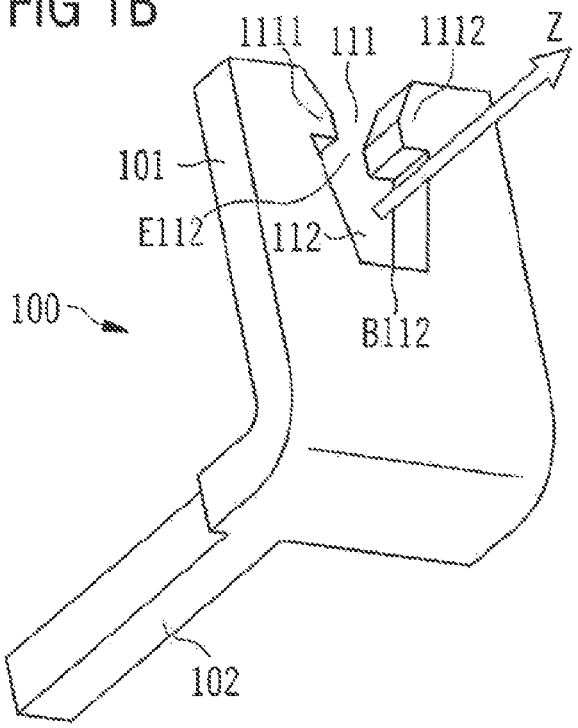
Figure 1C:
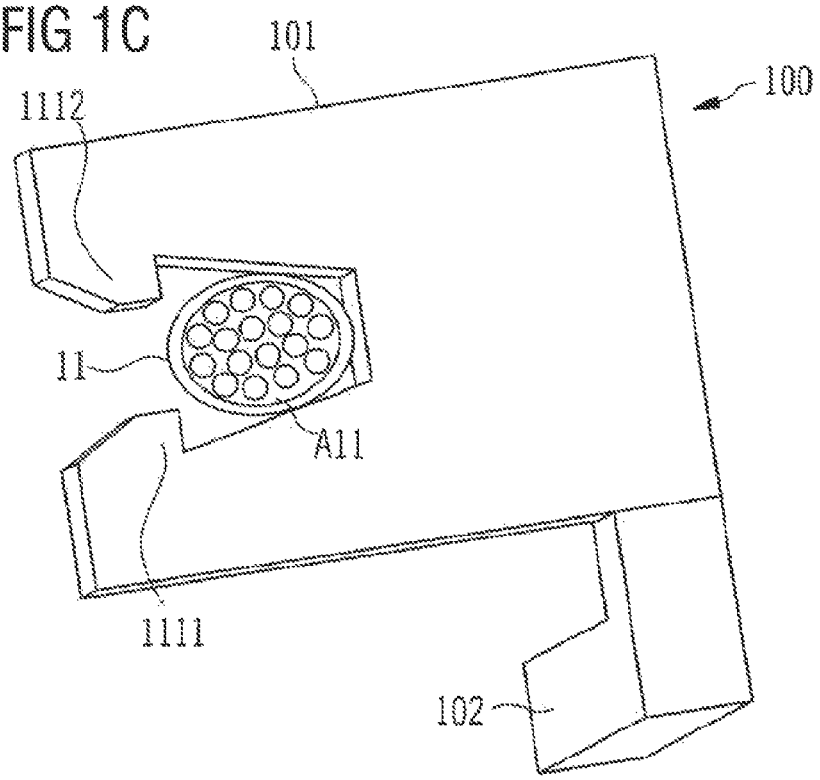
Figure 1D:
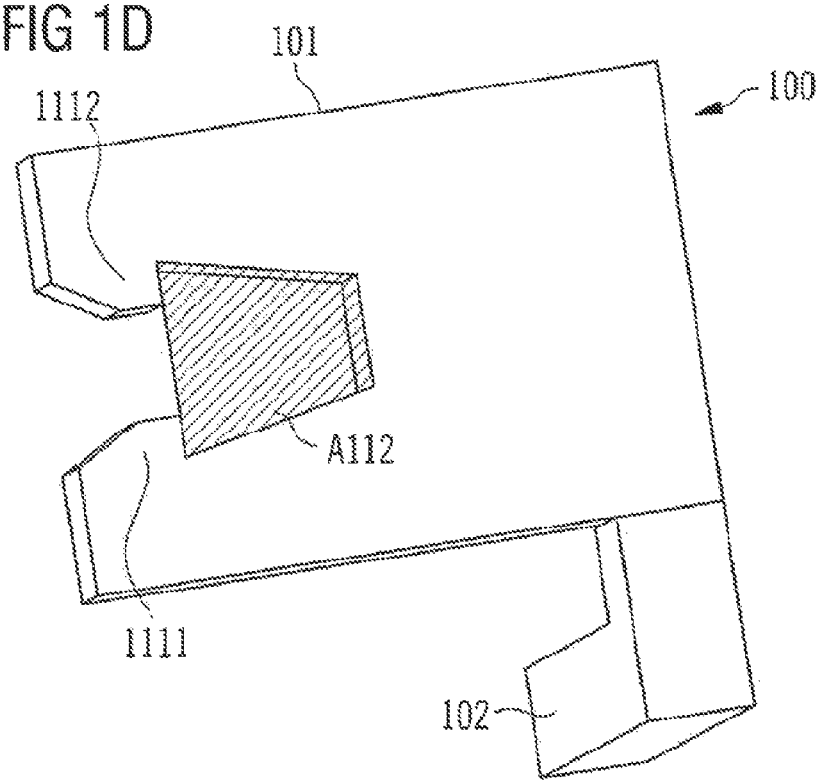
Figure 2A:
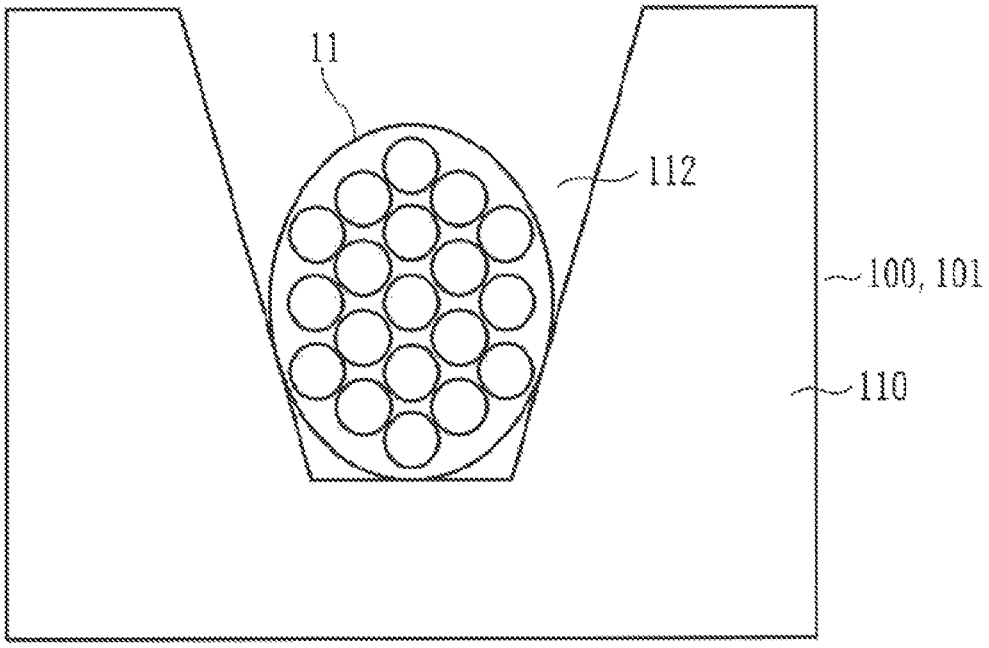
Figure 2B:
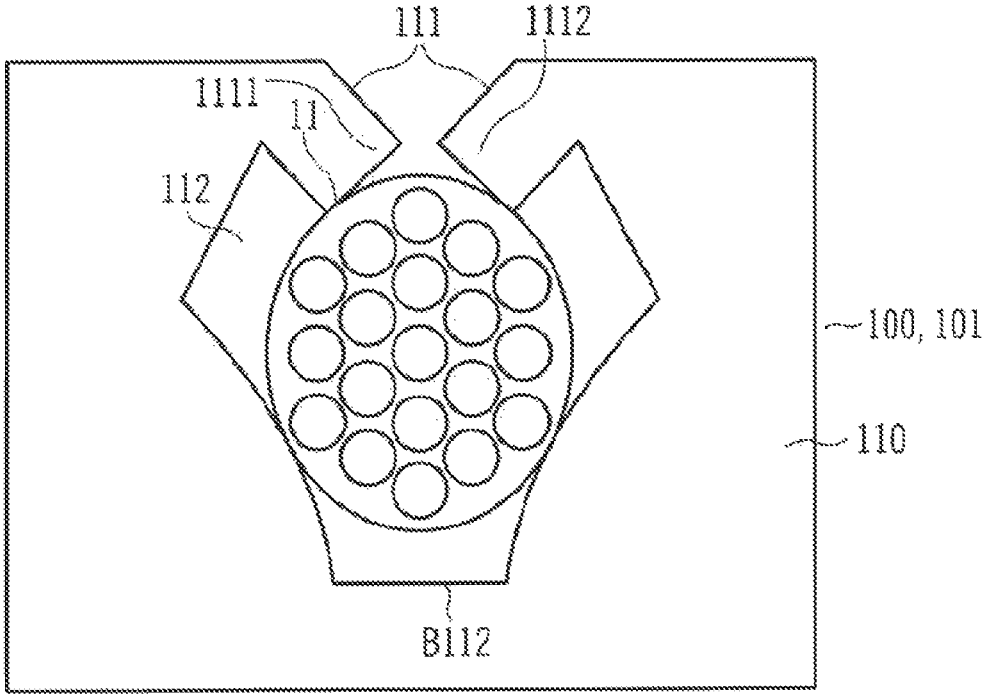
Figure 2C:
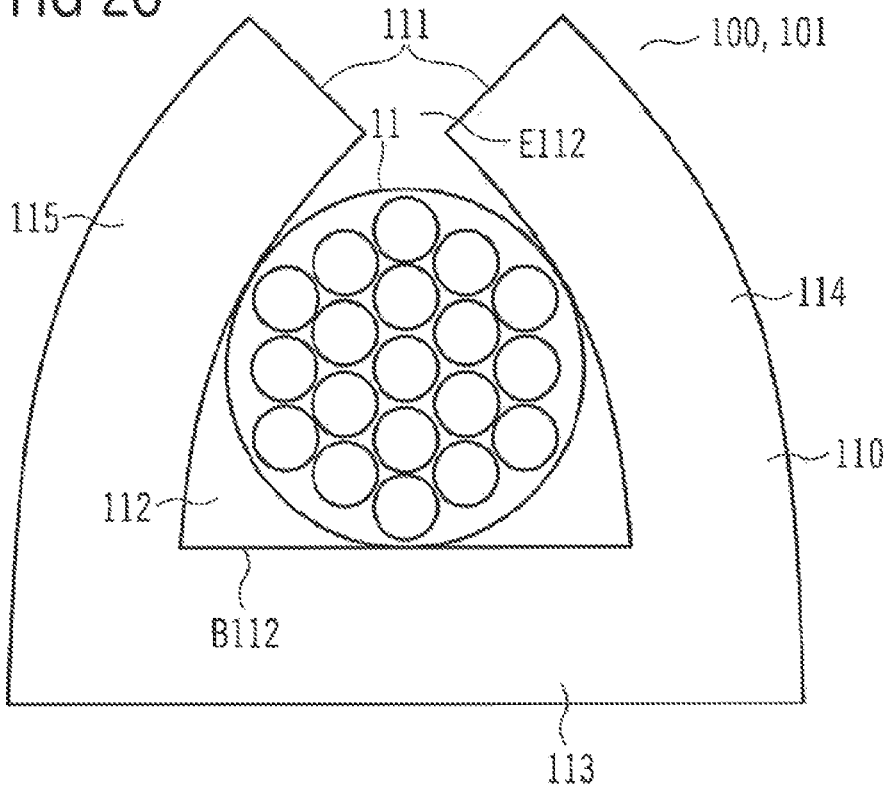
Figure 2D:
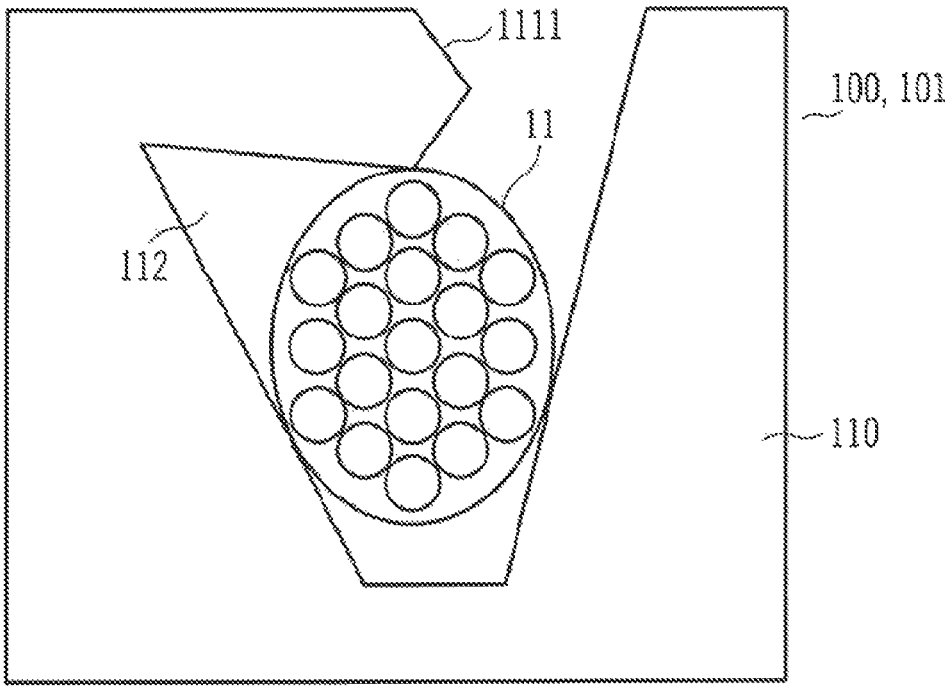
Figure 2E:
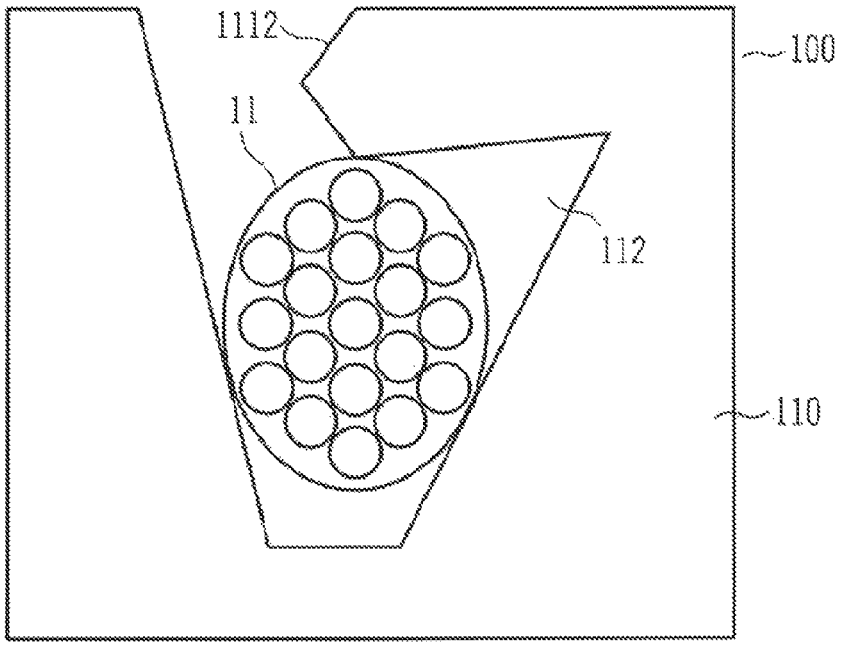
Figure 3:
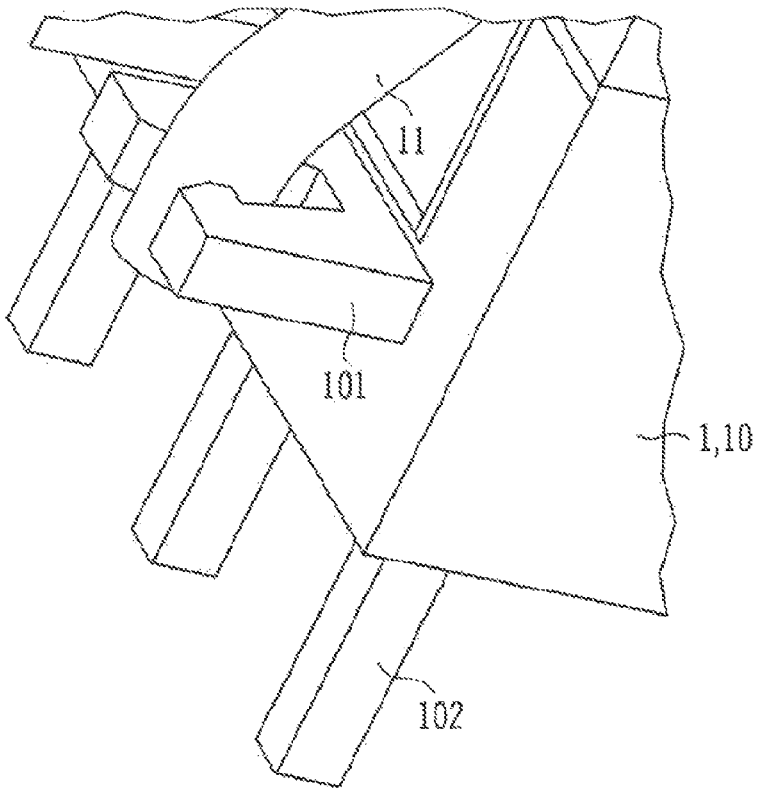

The invention will be explained in greater detail hereinafter on the basis of figures that show exemplary embodiments of the present invention and in which:

FIG. 1A shows an embodiment of a contacting device for connecting an electrical conductor, FIG. 1B shows a perspective view of an embodiment of a contacting device for connecting an electrical conductor, FIG. 1C shows an embodiment of a contacting device for connecting an electrical conductor with an electrical conductor retained in a clamping seat, FIG. 1D shows an embodiment of a contacting device with an area of a recess, FIG. 2A shows a further embodiment of a contacting device for connecting an electrical conductor, FIG. 2B shows a further embodiment of a contacting device for connecting an electrical conductor, FIG. 2C shows a further embodiment of a contacting device for connecting an electrical conductor, FIG. 2D shows a further embodiment of a contacting device for connecting an electrical conductor, FIG. 2E shows a further embodiment of a contacting device for connecting an electrical conductor, FIG. 3 shows an embodiment of a coil former/of an inductive electrical component with a contacting device for connecting an electrical conductor.

An embodiment of a contacting device 100 for connecting an electrical conductor is illustrated in FIGS. 1A, 1B, 1C and 1D. The figures show different views of the contacting device. The contacting device 100 comprises a connection contact 101 for fixing the electrical conductor. To this end, the connection contact 101 has a retainer 110. The retainer 110 is formed in such a way that the electrical conductor can be connected to the connection contact 101 by being clamped in the retainer 110 without the need to deform the retainer for this purpose.

The retainer 110 may have an accommodating region 112 for accommodating the electrical conductor. The accommodating region 112 has an inlet opening E112 and a base surface B112. The accommodating region 112 extends between the inlet opening E112 and the base surface B112. The accommodating region 112 tapers between the inlet opening E112 and the base surface B112 in such a way that a cross section A11 of the electrical conductor 11 deforms when the electrical conductor 11 is inserted into the accommodating region 112, whereby the electrical conductor is retained on the connection contact 101 in a clamping seat.

FIG. 1C shows the electrical conductor 11, which is deformed when clamped in the retainer 110. Due to the deformation of the cross section A11 thereof, the electrical conductor 11 can be fixed to the connection contact.

The retainer 110 may have at least one protrusion 111, which narrows the inlet opening E112 into the accommodating region 112. This material protrusion can be arranged above the accommodating region 112. Instead of a single protrusion, two material protrusions 1111 and 1112 may also be provided, as with the embodiment provided in FIGS. 1A, 1B, 1C and 1D, which protrusions delimit or narrow the inlet opening E112 into the accommodating region 112.

The retainer 110 can be formed as a material recess or groove in the material of the connection contact 101. The area A112 of the accommodating region 112 is adapted to the cross section of the electrical conductor to be clamped. For example, the recess can be formed in such a way that the area A112 corresponds at least to the cross section of the electrical conductor. With respect to the shape thereof, the recess or groove in the retainer 110 can be V-shaped in cross section or, as is shown in FIGS. 1A, 1B, 1C and 1D, can be trapezoidal.

The accommodating region 112 may have at least one first and second side wall. In the exemplary embodiment of FIGS. 1A, 1B, 1C and 1D, the accommodating region 112 has the side walls S112*a* and S112*b*. The base surface can be configured as a flat surface. A corner is formed between each of the side walls S112*a*, S112*b* and the flat base surface. The side walls S112*a*, S112*b* extend from opposite sides of the base surface B112 to the inlet opening E112. The side walls can be arranged at an angle of inclination relative to the base surface, such that the accommodating region 112 tapers continuously from the inlet opening E112 to the base surface B112.

The retainer 110, due to the protrusion 111, is formed so as to fix the electrical conductor in an x-direction, perpendicularly to the normal to the base surface B112, when the electrical conductor is inserted into the accommodating region. To this end, the protrusion may have the hooks 1111, 1112 shown in FIGS. 1A to 1D. During the insertion into the accommodating region, it is thus ensured that the electrical conductor does not slip out again from the accommodating region 112.

Due to the taper of the accommodating region 112, the retainer 110 is also formed to fix the electrical conductor in a z-direction when pressed further into the accommodating region 112, wherein the x- and z-direction are oriented orthogonally relative to one another. When connecting the electrical conductor to the contacting device, the cross section A11 of the electrical conductor is firstly deformed by the protrusion 111 and then by the shape of the accommodating region 112.

So that the protrusion 111 can fix the electrical conductor 11 in the x-direction, the distance between the protrusions 1111 and 1112 may be between 70% to 85% of the diameter of the electrical conductor. The distance should be selected in such a way that a wire of the electrical conductor is not damaged when the electrical conductor is pressed into the accommodating region 112.

Immediately beneath the inlet opening, the accommodating region 112 may be wider than immediately above the base surface. The accommodating region 112 can be formed in such a way that a ratio of an outer dimension da, which specifies a distance between the side walls S112*a*, S112*b* immediately beneath the inlet opening E112, to an inner dimension di, which specifies a width of the base surface between the side walls S112*a*, S112*b*, is 1.2 to 3, for example.

The side walls S112*a*, S112*b* can be arranged on the base surface at an angle of inclination between 5° and 15° with respect to a perpendicular to the base surface. It has proven to be particularly advantageous for the clamping of the electrical conductor 11 in the accommodating region 112 when the angle between the perpendicular to the base surface B112 and the side walls is 5° to 7°.

The contacting device 100 further comprises a contacting element 102 for applying an electrical signal to the contacting device. The contacting element 102 can be formed for example as a contact pin/contact peg. The connection contact 101 is electrically connected to the contact pin 102.

FIGS. 2A, 2B, 2C, 2D and 2E show further embodiments of the connection contact 101 of the contacting device 100. In the embodiment shown in FIG. 2A, the retainer 110 has merely one trapezoidal accommodating region 112, in which the electrical conductor 11 is clamped by deformation of the cross section thereof, such that it is fixed to the connection contact 101.

FIGS. 2B, 2C, 2D and 2E show further embodiments of the connection contact 101 of the contacting device 100, in which the connection contact 101 in each case has a protrusion 111 and an accommodating region 112. In the embodiment shown in FIG. 2B, the retainer 110 comprises two protrusions 1111 and 1112, which narrow the inlet opening E112 into the accommodating region 112 of the retainer 110. The protrusions 1111 and 1112 are turned inwardly in the direction of the accommodating region 112. The accommodating region has a bulge below each of the protrusions 1111, 1112. The accommodating region 112 in the upper region is thus wider and is narrower in the lower region toward the base surface B112 in order to deform the cross section of an inserted electrical conductor.

In the embodiment shown in FIG. 2C, the connection contact 110 has limbs 114, 115 arranged on a base part 113. The two limbs are bent upwardly toward one another under stress, such that the inlet opening E112 into the accommodating region 112 is narrowed. To insert the electrical conductor 11, the two limbs 114, 115 are bent away from one another and the electrical conductor is inserted into the accommodating region through the inlet opening. Due to stress, the two limbs then clamp the electrical conductor within the accommodating region between the limbs and the base surface B112, such that the electrical conductor is fixed.

FIGS. 2D and 2E each show embodiments of the connection contact 101 of the contacting device 100, in which the connection contact 101 has a retainer 110 with an accommodating region 112. However, the retainer 110 has just one protrusion 111, which narrows the inlet opening E112 into the accommodating region 112. In the embodiment shown in 2D, a protrusion 1111 extends from the left-hand side over the accommodating region 112, whereas in the embodiment shown in FIG. 2E a protrusion 1112 extends from the right-hand side over the accommodating region 112.

FIG. 3 shows a coil former 10 or an inductive electrical component 1 with a contacting device 100 according to one of the above-mentioned embodiments. In the exemplary embodiment of FIG. 3, the contacting device has the embodiment specified in FIGS. 1A, 1B, 1C and 1D. For example, the coil former 10 can be formed from a material made of plastic, and the contacting device 100 can be formed from a metal. The contacting device 100 can be cast into the material of the coil former 10 or can be overmoulded by the material of the coil former 10.

When applying the electrical conductor 11 around the coil former 10, the electrical conductor may first be fixed with one end to the connection contact 101 of the contacting device 100, whereas the rest of the conductor is wound around the coil former. Due to the fixing of the end of the electrical conductor in the x- and z-direction, the electrical conductor can be wound around the coil former with a tensile force. The protrusions of the retainer prevent the electrical conductor from sliding out from the accommodating region, whereas the form of the accommodating region tapered toward the base surface prevents the conductor from slipping out in the z-direction.

After the winding process, the other free end of the electrical conductor can be connected to a contacting device provided on the coil former 10 adjacently to the contacting device 100. To this end, the free end of the electrical conductor is clamped in the accommodating region of the connection contact of this adjacent contacting device. The ends of the electrical conductor are then shortened and for example can be soldered to the respective connection contact of the contacting devices. An inductive electrical component 1, for example a coil or a transformer, can thus be formed.

The electrical conductor 11 for example may be a stranded wire or also an enameled wire. By means of the retainer of the contacting device, the stranded wire or the enameled wire can be mechanically fixed to the connection contact of the contacting device prior to the actual soldering process. In order to connect the electrical conductor to the contacting device, there is thus no need for any complicated retainers of complex design. The electrical conductor can be connected to/terminated at the contacting device manually or by machine in an automated manner.

Due to the fixing of the electrical conductor in x- and z-directions orthogonal relative to one another, the electrical conductor can no longer detach by itself following one-time fixing to the contacting device. By means of the contacting device, it is thus possible to fix to said contacting device in particular stranded wires or enameled wires with a cross section larger than the cross section of the contacting element/contacting pin. For example, stranded wires or enameled wires with a cross section of 1.6 $mm^2$ can be electrically connected to a contact pin with a cross section of 1 $mm^2$.

LIST OF REFERENCE SIGNS

1 inductive electrical component
10 coil former
11 electrical conductor
100 contacting device
101 connection contact
102 contact peg
110 retainer
111 protrusion
112 accommodating region
113 base part
114, 115 limb
B112 base surface
S112 side wall
E112 inlet opening

The invention claimed is:

1. A contacting device for connecting an electrical conductor, comprising:

a connection contact for fixing the electrical conductor to the contacting device, wherein the connection contact has a retainer, wherein the retainer is formed in such a way that the electrical conductor can be connected to the contacting device by being clamped in the retainer and without bending of the retainer, wherein the retainer has an accommodating region for accommodating the electrical conductor, wherein the accommodating region has an inlet opening and a base surface and the accommodating region extends between the inlet opening and the base surface, wherein the base surface is configured as a flat surface, wherein the accommodating region continuously tapers from the inlet opening to the base surface in such a way that a cross section of the electrical conductor is deformed when the electrical conductor is inserted into the accommodating region, whereby the electrical conductor is held on the connection contact in a clamping seat, and wherein the retainer has at least one protrusion, which narrows the inlet opening into the accommodating region.

2. The contacting device according to claim 1, wherein the accommodating region is trapezoidal or V-shaped in cross section.

3. The contacting device according to claim 1, wherein the accommodating region has at least one first side wall and at least one second side wall, wherein the at least one first side wall and the at least one second side wall extend from opposite sides of the base surface to the inlet opening, and wherein the retainer is formed in such a way that the electrical conductor can be fixed to the retainer without bending of the at least one first side wall and the at least one second side wall.

4. The contacting device according to claim 3, wherein a corner is formed between the at least one first side wall and the base surface and between the at least one second side wall and the base surface.

5. The contacting device according to claim 3, wherein the at least one first side wall and the at least one second side wall are each arranged at an angle of inclination between 5° to 15° with respect to a perpendicular to the base surface.

6. The contacting device according to claim 3, wherein the distance between the at least first side wall and the at least one second side wall immediately beneath the inlet opening is greater than the width of the base surface between the at least one first side wall and the at least one second side wall.

7. The contacting device according to claim 6, wherein the ratio between the distance between the at least one first side wall and the at least one second side wall immediately beneath the inlet opening and the width of the base surface between the at least one first side wall and the at least one second side wall is 1.2 to 3.

8. The contacting device according to claim 1, comprising:

a contact pin for applying an electrical signal, wherein the connection contact and the contact pin are interconnected and are formed from the same material piece.

9. A coil former around which an electrical conductor is to be wound, comprising:

a contacting device for connection of the electrical conductor according to claim 1.

10. An inductive electrical component, in particular a coil or transformer, comprising:

a coil former according to claim 9, wherein the electrical conductor is wound around the coil former, and wherein the electrical conductor is retained in the accommodating region of the connection contact in a clamping seat.

11. The inductive electrical component according to claim 10, wherein the electrical conductor is formed as a stranded or enameled wire with a cross section between 0.05 $mm^2$ and 95 $mm^2$.

12. A method for connecting an electrical conductor to a contacting device of a coil former comprising:

providing the coil former according to claim 9; and fixing the electrical conductor to the connection contact of the contacting device by inserting the electrical conductor into the accommodating region of the connection contact in such a way that the cross section of the electrical conductor is deformed when the electrical conductor is inserted into the accommodating region, whereby the electrical conductor is retained on the connection contact in a clamping seat.

13. The method according to claim 12, wherein the electrical conductor, following the insertion through the inlet opening into the accommodating region, is fixed by the protrusion in a first direction parallel to the perpendicular to the base surface of the accommodating region and is then fixed to the connection contact in a second direction perpendicular to the first direction by being pressed against the base surface.

14. The method according to claim 12, comprising:

fixing the electrical conductor to the connection contact in such a way that an end of the electrical conductor protrudes from the retainer; and applying a solder material to the end of the electrical conductor, whereby the end of the electrical conductor is electrically contacted with the connection contact.

* * * * *